US005544876A

United States Patent [19]

Ruch

[11] Patent Number: 5,544,876

[45] Date of Patent: Aug. 13, 1996

[54] PRINTED PAPER RECEIVING AND STACKING APPARATUS FOR AN IMAGE REPRODUCTION MACHINE

[75] Inventor: Mark H. Ruch, Spring, Tex.

[73] Assignee: Compaq Computer Corporation, Houston, Tex.

[21] Appl. No.: 260,697

[22] Filed: Jun. 16, 1994

[51] Int. Cl.[6] ..... B65H 29/42

[52] U.S. Cl. ..... 271/179; 271/212

[58] Field of Search ..... 271/179, 212, 271/178; 414/795.3, 795.1, 795; 347/104

[56] References Cited

U.S. PATENT DOCUMENTS 3,847,382 11/1974 McKee ..... 271/179 X

FOREIGN PATENT DOCUMENTS 5227164 3/1977 Japan ..... 271/212

252278 5/1926 United Kingdom ..... 271/212

*Primary Examiner*—David H. Bollinger

*Attorney, Agent, or Firm*—Konneker & Smith

[57] ABSTRACT

An inkjet printer is operative to horizontally discharge successive printed paper sheets printed side up into a specially designed sheet receiving and stacking section of the printer. A spaced plurality of vertically oriented helical drive members disposed in the receiving and stacking section are continuously rotated during the printing operation and are arranged in laterally opposed pairs that receive opposite side edge portions of the discharged printed sheets. Rotation of the helical drive members upwardly moves each successively received sheet, keeping the sheets in a vertically spaced, parallel relationship that permits the ink on each sheet to dry before the sheets upwardly exit and are supported on the top ends of the drive members in a printed sheet stack in which the first printed sheet is on top of the stack and the last printed sheet is on the bottom of the stack. Upon completion of a particular printing job the stack is removed from the receiving and stacking station and is ready for use without the necessity of reversing the order of the printed sheets in the removed stack.

19 Claims, 3 Drawing Sheets

PRINTED PAPER RECEIVING AND STACKING APPARATUS FOR AN IMAGE REPRODUCTION MACHINE

BACKGROUND OF THE INVENTION

1. Field of the Invention

The present invention generally relates to image reproduction machines, such as printers and copiers, and more particularly relates to apparatus for receiving and stacking printed paper sheets discharged from such machines.

2. Description of Related Art

Inkjet printers have recently become quite popular adjuncts to personal computers due to their simplicity, reliability, relatively low cost and relatively high print quality. Despite this popularity, however, two well known limitations are commonly associated with inkjet printers of conventional construction.

First, as each printed sheet exits the printer its ink is still wet and the printing must be isolated against contact with other sheets (or other portions of the printer) until the ink is dry to avoid smearing of the sheet. Typically, each successively printed sheet drops, printed side up, onto the top of a stack of previously printed sheets. Since the page/minute printing rate of most inkjet printers currently available is relatively low (on the order of about two to five pages per minute) the ink on each sheet usually has sufficient time to dry before the next sheet comes into contact with the ink. However, inkjet printers are currently being developed with substantially greater printing rate capacities (on the order of 20 pages per minute). When these printers become available the potential for one discharged sheet from contacting and smearing the ink on the previously printed sheet will be greatly increased.

Second, in conventional inkjet printers the printed sheets discharged from the printer are stacked with the first printed sheet on the bottom of the stack and the last printed sheet on the top of the stack. This requires, for each print job, that the printer operator remove the printed stack and laboriously reverse the sheet order therein to provide the proper text sequence in the stack. Additionally, when looking at the discharged stack the operator cannot usually tell at a glance which of several print jobs he is looking at since the visible top sheet is the last sheet in the print job as opposed to its title sheet which is on the bottom of the stack. This reverse stacking order problem is not limited to inkjet printers but also exists in the realms of laser printers as well as other types of image reproduction machines such as copiers. While this problem may be overcome by programming the machine to print the pages in reverse order (so that they will be stacked with the first sheet on the top and the last sheet on the bottom), this undesirably increases the memory requirements of the machine.

It can readily be seen from the foregoing that it would be desirable to provide improved image reproduction and paper handling apparatus, such as an inkjet printer, that eliminates or at least substantially reduces the above-mentioned problems, limitations and disadvantages commonly associated with conventional image reproduction machines of the type generally described above. It is accordingly an object of the present invention to provide such improved apparatus.

SUMMARY OF THE INVENTION

In carrying out principles of the present invention, in accordance with a preferred embodiment thereof, an image reproduction machine is provided and includes printing means for receiving a stack of imprintable sheets, imprinting selected indicia on a side of each sheet, and successively discharging the printed sheets, printed side up, in a horizontal direction.

The image reproduction machine, representatively an inkjet printer, incorporates therein specially designed printed sheet receiving and stacking means operative to receive the discharged printed sheets and form therefrom a printed sheet stack in which the printed sheets, printed side up, are successively disposed, from top to bottom, in the order in which they were discharged from the printing means.

The printed sheet receiving and stacking means include a spaced plurality of vertically oriented helical first means supported for driven rotation about vertical axes and having top end portions. The helical first means are operative, during rotation thereof and discharge of printed sheets from the printing means, to form the printed sheet stack on the top end portions of the helical first means by sequentially receiving and supporting each successively discharged sheet, moving the supported sheet upwardly along the lengths of the helical first means, and then causing the supported sheet to upwardly exit the helical first means and come to rest on the top end portions thereof. Second means are also provided and are selectively operable to rotationally drive the plurality of helical first means about their vertical axes.

As each discharged printed sheet is received by the helical first means it is isolated from the other discharged sheets during its upwardly driven travel along the vertical lengths of the helical first means, thereby allowing its ink to dry before the sheet is brought into contact with the bottom of printed sheet stack being formed on the upper end portions of the helical first means. Not only does this relatively simple helical drive system permit extra ink drying time for each printed sheet, but it also automatically stacks the printed sheets in their correct order so that the printed sheets do not have to be rearranged after their removal from the printer.

DETAILED DESCRIPTION

Figure 1:
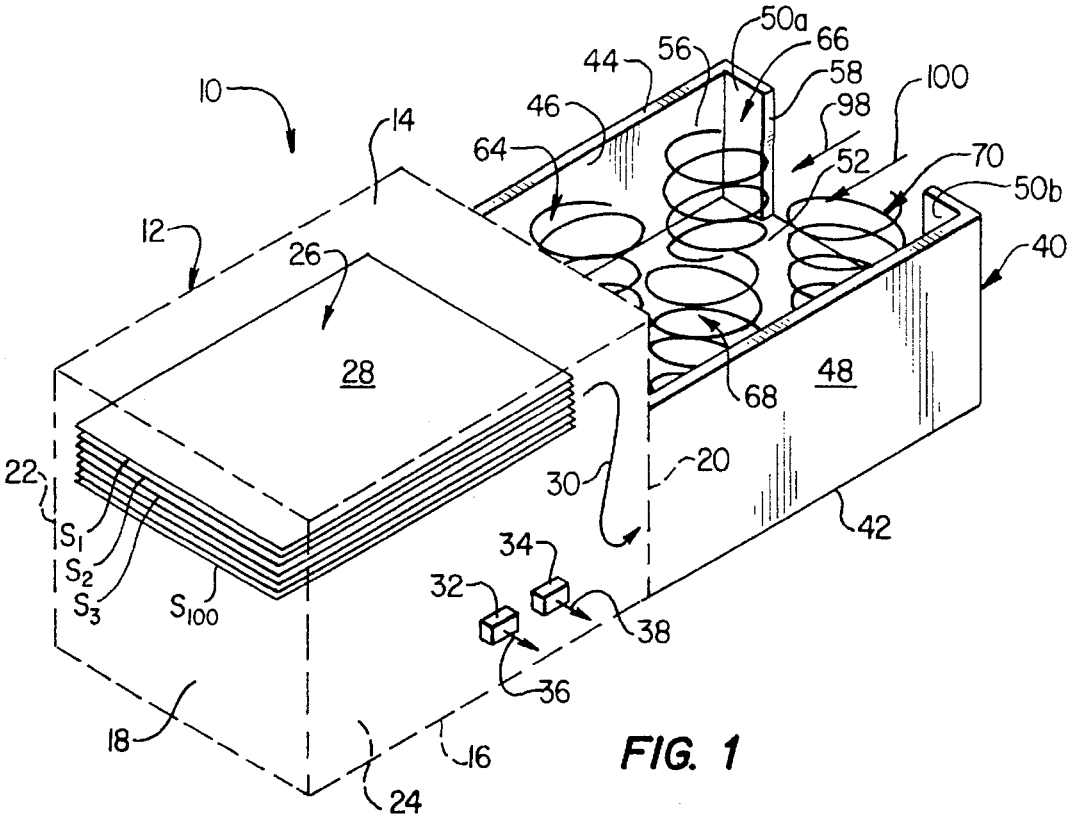
FIG. 1 is a simplified perspective view, partially in phantom, of a representative inkjet printer incorporating therein a specially designed printed paper sheet receiving and stacking section embodying principles of the present invention.
Figure 2:
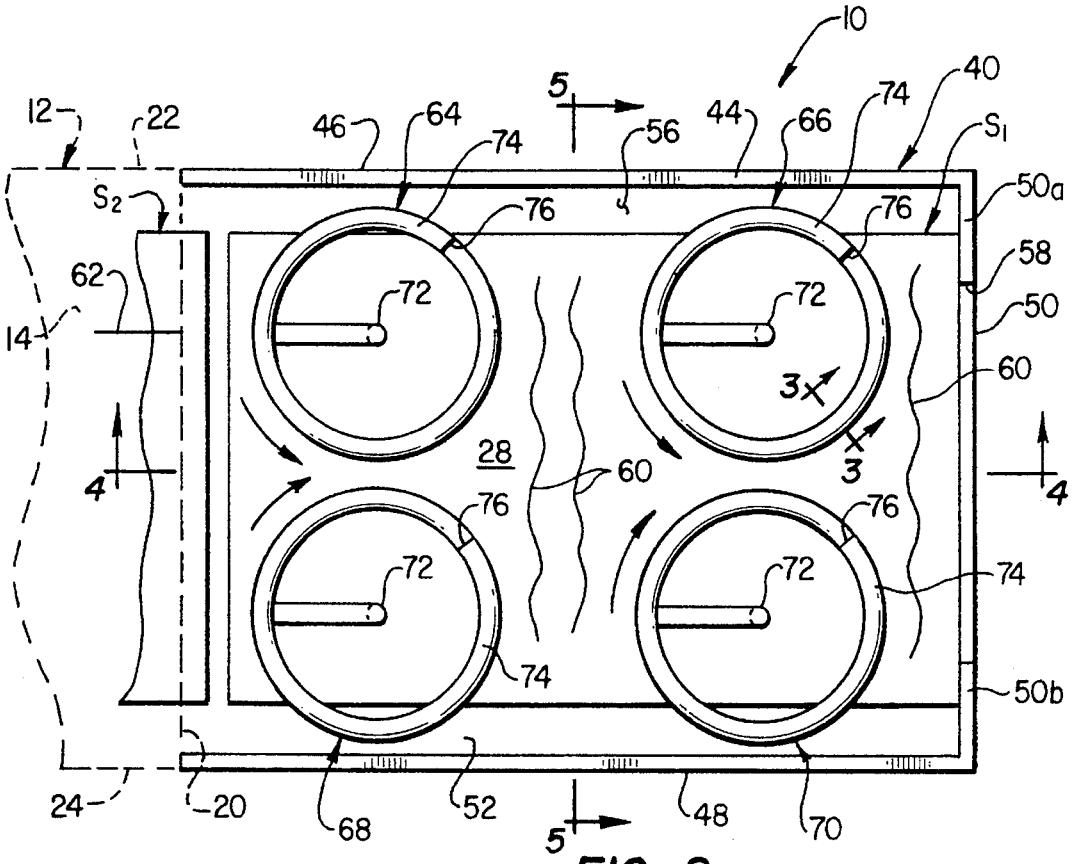
FIG. 2 is an enlarged scale top plan view of the sheet receiving and stacking section of the printer.

Illustrated in simplified form in FIGS. 1 and 2 is a representative inkjet printer 10 embodying principles of the present invention. Printer 10 includes a rectangular printing portion 12, of a generally conventional construction and operation, with top and bottom sides 14 and 16, front and rear ends 18 and 20, and opposite left and right sides 22 and 24.

Printing portion 12 is operative to hold a horizontally oriented stack 26 of paper sheets including, from top to bottom, sheets $S_1$–$S_{100}$ to be ink-imprinted on their top sides 28. For purposes of discussion it will assumed that the printing portion 12 is operative to sequentially feed the sheets $S_1$–$S_{100}$, as needed in accordance with a particular printing job, through the indicated internal printing path 30.

Among other controls disposed within the printing portion 12 are schematically depicted sensors 32 and 34. Sensor 32 is operative to detect the discharge of each sheet from the printing portion 12 and responsively generate an output signal 36. Sensor 34 is operative to detect the completion of each selected printing job and responsively generate an output signal 38.

Referring now to FIGS. 1, 2, 4 and 5, a specially designed printed sheet receiving and stacking station 40 is secured to the rear end 20 of the printing portion 20 and has a housing portion with a generally rectangular configuration, a bottom side wall 42, an open top side 44, opposite left and right vertical side walls 46 and 48, and a vertical rear end wall 50. A horizontally extending interior wall 52 vertically divides the interior of the receiving and stacking station 40 into a drive chamber 54 disposed beneath the wall 52 and an open-topped receiving and stacking chamber 56 disposed above the wall 52. For purposes later described, above the interior dividing wall 52 the rear end wall 50 has a central cutout area 58 formed therein and leaving opposed left and right stop portions **50*a*,50*b* extending upwardly from the dividing wall 52 to the open top side 44 of the receiving and stacking station 40**.

As each sheet traverses the internal printing path 30 within the printing portion 12 the printing portion, in a conventional manner, deposits ink on the top side 28 of the sheet to form thereon the desired printed indicia 60 thereon (see FIG. 2). The printed sheet is then rearwardly discharged, top side up (as indicated by the arrow 62 in FIG. 2), into a lower portion of the interior of the receiving and stacking chamber 56 for handling therein in a manner subsequently described herein.

The printed paper receiving and stacking station 40 also includes four helically configured drive members 64, 66, 68 and 70 vertically disposed in a mutually spaced orientation within the receiving and stacking chamber 56 for driven rotation about vertical axes. As illustrated, the drive members 64,68 are positioned forwardly of the drive members 66,70 with the drive members 64,66 being respectively adjacent the left side wall 46 of the receiving and stacking station 40 and the drive members 68,70 being respectively adjacent the right side wall 48 of the receiving and stacking station 40.

Figure 4:
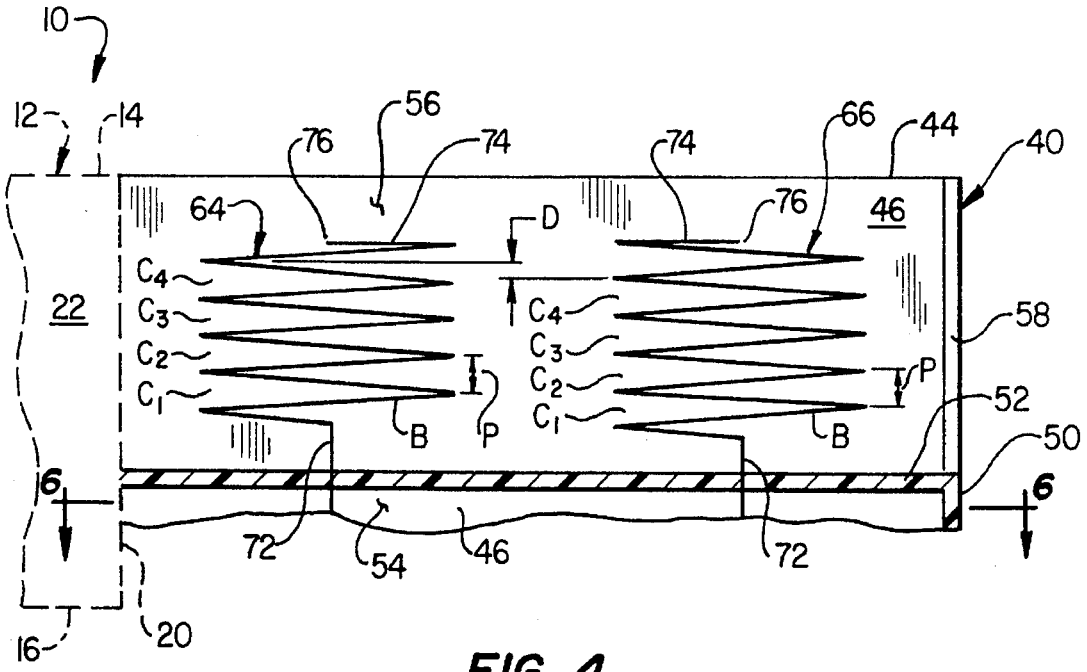
FIG. 4 is a schematic cross-sectional view through the sheet receiving and stacking section taken along line 4—4 of FIG. 2 and illustrating a pair of the helical drive members therein.
Figure 5:
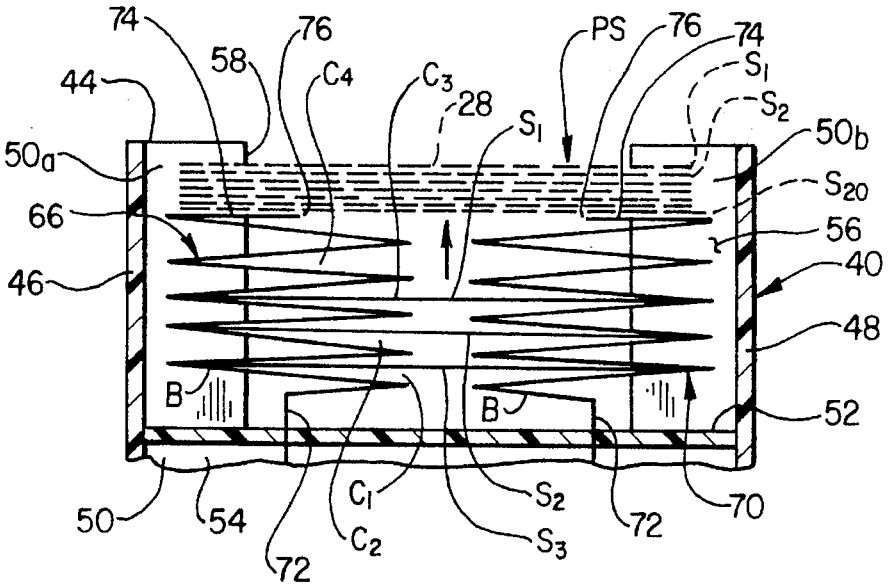
FIG. 5 is a schematic cross-sectional view through the sheet receiving and stacking section taken along line 5—5 of FIG. 2 and illustrating the sheet stacking operation of the helical drive members therein.

At the lower end of each of the four helical drive members is an axially extending, circularly cross-sectioned lower end portion 72 that is rotatably extended downwardly through the dividing wall 52 into the drive chamber 54. Above its lower end portion 72, each of the drive members 64, 66, 68 and 70 has an upwardly spiraling body portion B terminating in an essentially horizontal upper end portion 74 having an outer end face 76. As illustrated in FIGS. 4 and 5, the horizontal upper end portions 74 of the helical drive members 64, 66, 68 and 70 are level with one another and are downwardly offset from the open top side 44 of the receiving and stacking station 40.

The four helical drive members 64, 66, 68 and 70 are of substantially identical configurations with the exception that the left side drive members 64, 66 are of an opposite "hand" than the right side drive members 68,70. Specifically, the bodies B of the drive members 64,66 spiral upwardly in a clockwise direction as viewed in FIG. 2, while the bodies B of the drive members 68,70 spiral upwardly in a counterclockwise direction as viewed in FIG. 2.

Figure 3:
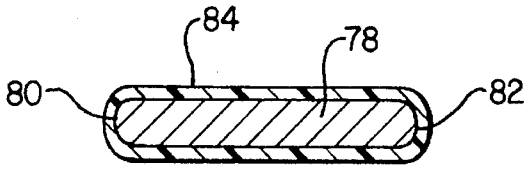
FIG. 3 is an enlarged scale cross-sectional view, taken along line 3—3 of FIG. 2, through a portion of one of the helical drive members used in the sheet receiving and stacking section.

FIG. 3 illustrates the cross-section of each of the helical drive members 64, 66, 68 and 70 along the length of its spiraling body B. Each body portion B has a flattened metal core portion 78 with rounded opposite side edges 80 and 82. Along its length, including its horizontal upper end portion 74, the metal body portion core 78 externally coated with a layer of low friction, high strength, wear resistant material 84, representatively an ultra high molecular weight polyethylene material (UHMWPE).

As best illustrated in FIG. 5, each of the opposing drive member pairs 64,68 and 66,70 has, along its vertical length, a plurality of coils. Representatively, each drive member has four coils designated from bottom to top as $C_1$–$C_4$, although a greater or lesser number of coils could be used as necessary or desired. The pitch P between each vertically adjacent coil pair on a given drive member (see FIG. 4) is relatively small, representatively on the order of about 0.5 inches. The four helical drive members 64, 66, 68 and 70 are relatively oriented in a manner such the coils $C_1$–$C_4$ in each of the drive member pairs 64,68 and 66,70 have side openings that face and are vertically aligned with one another as best illustrated in FIG. 5. As shown in FIG. 4, the coils $C_1$–$C_4$ in the rear drive member pair 66,70 are downwardly offset a small distance D from the coils $C_1$–$C_4$ in the front drive member pair 64,68.

Figure 6:
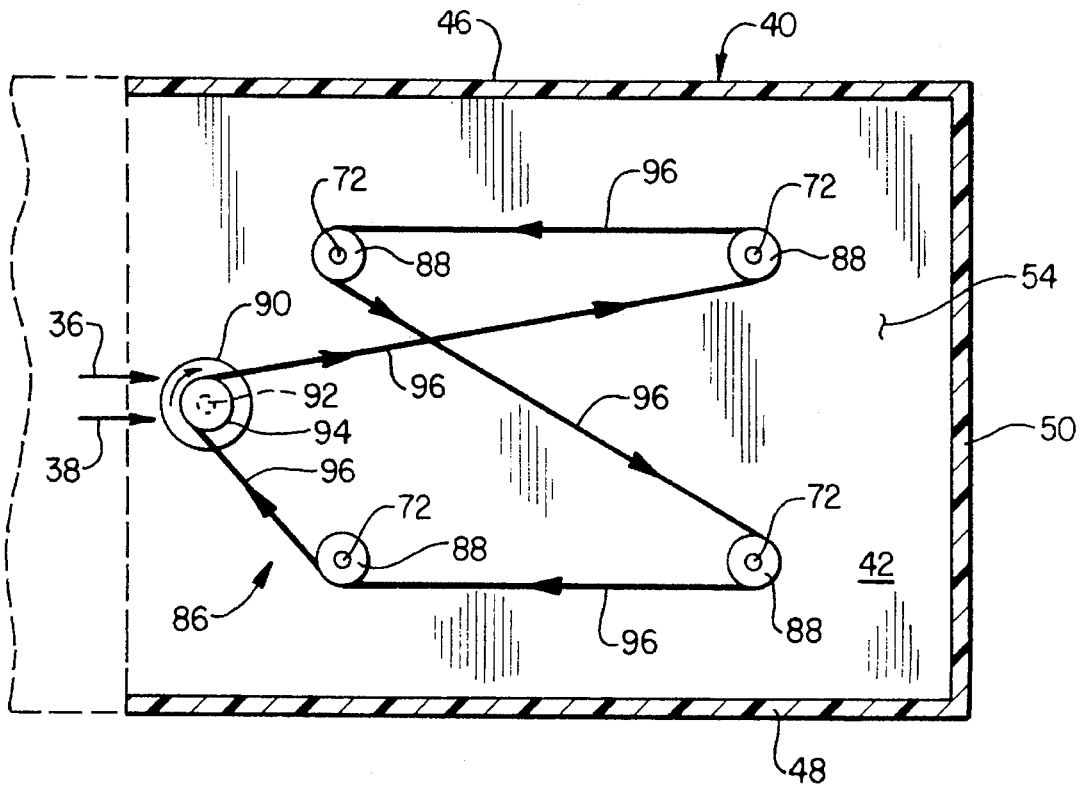
FIG. 6 is a schematic cross-sectional view through the sheet receiving and stacking section taken along line 6—6 of FIG. 4 and illustrating a motorized drive system used to rotate the helical drive members.

Referring now to FIGS. 2 and 6, as viewed in FIG. 2, under the control of the printing portion 12 the left side helical drive members 64,66 are rotationally driven in a counterclockwise direction, while the right side helical drive members 68,70 are driven in a clockwise direction, by a schematically depicted motorized drive system 86 shown in FIG. 6 and disposed in the drive chamber 54.

The drive system 86 includes pulleys 88 coaxially anchored to the lower ends of the lower drive member end portions 72 within the drive chamber 54, an electric motor 90 having a drive shaft 92 to which a main drive pulley 94 is coaxially anchored, and a nonreinforced elastomeric drive belt 96 looped around the pulleys 88 and 94 as indicated in FIG. 6. Motor-driven rotation of the pulley 92 in the indicated clockwise direction drives the belt 96 in the arrow-indicated directions to thereby simultaneously rotate the helical drive members 64,66 in a counterclockwise direction and the helical drive members 68,70 in a clockwise direction.

To illustrate the operation of the inkjet printer 10 it will be assumed that a selected printing task will require 20 sheets—namely sheets $S_1$–$S_{20}$ from the 100 sheet stored paper stack 26 shown in FIG. 1. In response to the inputting of an appropriate "print" command to the printing portion 12, the drive motor 90 is started to continuously rotate the helical drive member pairs 64,68 and 66,70 in the opposite directions indicated in FIG. 2.

As the first printed sheet $S_1$ is rearwardly discharged printed side up from the printing portion 12, opposite left and right edges of the sheet $S_1$ enter the facing open sides of the bottom coils $C_1$ of the opposing helical drive member pair 64,68 and then enter the facing open sides of the bottom coils $C_1$ of the opposing helical drive member pair 66,70. The indicated counter-rotation of the left and right side drive members assists in rearwardly driving the printed sheet $S_1$ toward the rear stop wall portions 50*a*,50*b* until the leading edge of the printed sheet $S_1$ engages and is stopped by the wall portions 50,*a*,50*b* as indicated in FIG. 2. This rearward movement of the printed sheet $S_1$ is further assisted by gravity due to the previously mentioned small vertical coil offset D (see FIG. 4) between the helical drive member pairs 64,68 and 66,70.

The opposite side edges of the printed sheet $S_1$ rest on the bottom sides of the coils $C_1$, and the ink-imprinted indicia 60 on the top side 28 of the printed sheet $S_1$ (see FIG. 2) is not touched by the drive members that support the sheet. As schematically shown in FIG. 5, the continuous rotation of the four helical drive members 64, 66, 68 and 70 progressively lifts the printed sheet $S_1$ from the coils $C_1$ to the coils $C_2$, from the coils $C_2$ to the coils $C_3$, and so on until the printed sheet $S_1$ upwardly exits the helical drive members and rests on top of their horizontal upper end portions 74.

As schematically illustrated in FIG. 5, this process is repeated for each successive printed sheet $S_2$–$S_{20}$ until, as shown in phantom in FIG. 5, all of the printed sheets $S_1$–$S_{20}$ are stacked, in a printed sheet stack PS atop the horizontal upper ends 74 of the helical drive members. During the upward movement of each successive one of the printed sheets $S_1$–$S_{20}$ onto the bottom side of the stack PS the sheets are vertically separated from one another until they reach the stack PS.

Accordingly, the various printed indicia 60 on the printer-discharged sheets is not touched by anything during the helically driven upward movement of the discharged sheets, thereby providing the inked indicia with substantial untouched drying time before stacking of the sheets. This "time" drying of the inked indicia may be augmented, if desired, by the flowing of supplemental air and or heat (as schematically represented by the arrows 98, 100 in FIG. 1) into the stacking chamber 56. The vertical separation of the sheets prior to their stacking substantially facilitates high printed sheet discharge rates in the printer 10 without smearing of the ink on the discharged sheets.

As can be seen in FIGS. 4 and 5, the downward offset D between the horizontal upper ends of the helical drive members and the top side of the receiving and stacking station 40 provides a convenient stacking area for the printed sheets. Top edge portions of the walls 46,48,50*a* and 50*b* serve to captively retain the stack PS atop the drive members. The stack PS can be easily removed by simply reaching in through the upper end of the wall cutout area 58 and grasping the front end of the stack PS.

According to another key aspect of the present invention it should be noted that once the printed paper stack PS is removed from the receiving and stacking station 40 there is no need to reverse the order of the printed sheets to place them in the correct reading sequence—the printed sheets are automatically stacked in the correct sequence. This correct sequence stacking built into the printer 10 also provides the advantage that the user of the printer 10 can simply look at the top of the stack PS and instantly ascertain which print job has just been completed. There is no need to guess or remove the bottom sheet to obtain this information.

As illustrated and described herein, the four helical drive members 64, 66, 68 and 70 are continuously rotated during a given printing job. To assure that each discharged printed sheet in a given printing job is delivered to the stack PS at the end of the printing job the operation drive motor 90 is appropriately continued for an appropriate time period after the generation of the output signal 38 (indicative that the particular print job is complete) to assure that the last printed sheet $S_{20}$ is moved up onto the bottom of the stack PS. For example, in the four coil drive member embodiment shown the motor 90 would be rotated a sufficient time to rotate the drive members an additional four revolutions.

While the helical drive members 64, 66, 68 and 70 have been representatively described as being continuously rotated during a given printing job, it will be appreciated that they could also be stopped for the receipt of each successive sheet and then rotated one revolution to stationarily position them for receipt of the next sheet. Additionally, the rotational speed of the helical drive members could be varied in response to the type of indicia (for example, text vs. graphics) being imprinted on the sheets internally traversing the printing portion 12.

It will also be appreciated that the number of drive member coils, the rotational speed of the helical drive members, the vertical coil pitch P, the vertical lengths of the helical drive members, as well as other geometrical aspects of the representatively illustrated drive and stacking system, could be varied to suit differing printing parameters such as paper size, imprinting medium, paper discharge rate and the like.

The foregoing detailed description is to be clearly understood as being given by way of illustration and example only, the spirit and scope of the present invention being limited solely by the appended claims.

What is claimed is:

1. An image reproduction machine comprising:

printing means for receiving a stack of imprintable sheets, imprinting selected indicia on sides of the sheets, and successively discharging the printed sheets, printed side up, in a horizontal direction; and printed sheet receiving and stacking means for receiving the discharged printed sheets and forming therefrom a printed sheet stack in which the printed sheets, printed side up, are successively disposed, from top to bottom, in the order in which they were discharged from said printing means, said printed sheet receiving and stacking means including:

a spaced plurality of vertically oriented helical first means supported for driven rotation about vertical axes and having top end portions, said helical first means being operative, during rotation thereof and discharge of printed sheets from said printing means, to form said printed sheet stack on said top end portions by sequentially receiving and supporting each successively discharged sheet, moving the supported sheet upwardly along the lengths of said helical first means, and then causing the supported sheet to upwardly exit said plurality of helical first means and come to rest on said top end portions thereof, said spaced plurality of vertically oriented helical first means including a first spaced apart pair of helical drive members positioned to laterally receive a first side edge portion of each sheet discharged from said printing means, and a second spaced apart pair of helical drive members positioned to laterally receive a second side edge portion of each sheet discharged from said printing means, and second means selectively operable to rotationally drive said plurality of helical first means about said vertical axes, said printing means being operative to discharge the printed sheets in a first horizontal direction, said first pair of helical drive members being spaced apart in said first horizontal direction, with a first one of said first pair of helical drive members being positioned between said printing means and the second one of said first pair of helical drive members, said second pair of helical drive members being spaced apart in said first horizontal direction, with a first one of said second pair of helical drive members being positioned between said printing means and the second one of said second pair of helical drive members, and said second ones of said first and second pairs of helical drive members being downwardly offset from said first ones of said first and second pairs of helical drive members.

2. The image reproduction machine of claim 1 wherein:

said image reproduction machine is an inkjet printer.

3. The image reproduction machine of claim 1 wherein:

said second means are operative to drive said first pair of helical drive members in a first rotational direction, and to drive said second pair of helical drive members in a second rotational direction opposite to said first rotational direction.

4. The image reproduction machine of claim 1 wherein:

said spaced plurality of vertically oriented helical first means are operative, during rotation thereof, to drive their supported printed sheets generally horizontally away from said printing means, and said printed sheet receiving and stacking means further include stop means for engaging the supported printed sheets and limiting their movement away from said printing means by said helical first means.

5. The image reproduction machine of claim 1 further comprising:

wall means, disposed generally above said top end portions of said helical first means, for forming around said printed sheet stack a barrier limiting horizontal movement thereof relative to said top end portions of said helical first means.

6. The image reproduction machine of claim 1 wherein:

said second means are operative to continuously rotate said plurality of helical first means during discharge of printed sheets from said printing means.

7. The image reproduction machine of claim 1 wherein:

said second means are operative to intermittently rotate said plurality of helical first means during operation of said printing means.

8. The image reproduction machine of claim 1 wherein:

said helical first means, during driven rotation thereof, are operative to support a vertically spaced plurality of printed sheets and upwardly transfer them, top sheet first, onto the bottom of said printed sheet stack.

9. The image reproduction machine of claim 1 wherein:

said printing means are operative to form an ink-based imprintation on the imprintable sheets.

10. An image reproduction machine comprising:

printing means for receiving a stack of imprintable sheets, imprinting selected indicia on sides of the sheets, and successively discharging the printed sheets, printed side up, in a horizontal direction; and printed sheet receiving and stacking means for receiving the discharged printed sheets and forming therefrom a printed sheet stack in which the printed sheets, printed side up, are successively disposed, from top to bottom, in the order in which they were discharged from said printing means, said printed sheet receiving and stacking means including:

a spaced plurality of vertically oriented helical first means supported for driven rotation about vertical axes and having top end portions, said helical first means being operative, during rotation thereof and discharge of printed sheets from said printing means, to form said printed sheet stack on said top end portions by sequentially receiving and supporting each successively discharge sheet, moving the supported sheet upwardly along the lengths of said helical first means, and then causing the supported sheet to upwardly exit said plurality of helical first means and come to rest on said top end portions thereof, and second means selectively operable to rotationally drive said plurality of helical first means about said vertical axes, said plurality of helical first means having axially extending lower end portions, and said second means including a motor operatively coupled to a drive pulley, a plurality of driven pulleys coaxially secured to said lower end portions of said plurality of helical first means, and a flexible drive belt operatively looped around said drive pulley and said plurality of driven pulleys.

11. An image reproduction machine comprising:

printing means for receiving a stack of imprintable sheets, imprinting selected indicia on sides of the sheets, and successively discharging the printed sheets, printed side up, in a horizontal direction; and printed sheet receiving and stacking means for receiving the discharged printed sheets and forming therefrom a printed sheet stack in which the printed sheets, printed side up, are successively disposed, from top to bottom, in the order in which they were discharged from said printing means, said printed sheet receiving and stacking means including:

a spaced plurality of vertically oriented helical first means supported for driven rotation about vertical axes and having top end portions, said helical first means being operative, during rotation thereof and discharge of printed sheets from said printing means, to form said printed sheet stack on said top end portions by sequentially receiving and supporting each successively discharged sheet, moving the supported sheet upwardly along the lengths of said helical first means, and then causing the supported sheet to upwardly exit said plurality of helical first means and come to rest on said top end portions thereof, and second means selectively operable to rotationally drive said plurality of helical first means about said vertical axes, said helical first means being operative to support, in a vertically spaced, mutually parallel array, a plurality of printed sheets, including a lowermost printed sheet, said printing means being operative to output a signal indicative of the completion of a selected printing job, and said second means being operable in response to generation of said signal to subsequently rotate said helical first means through rotational arcs sufficient to upwardly move said lowermost printed sheet out of said helical first means and onto the bottom of said printed sheet stack.

12. A printer comprising:

a printing section having a rear side, said printing section being operative to receive a stack of paper sheets, imprint selected ink-based indicia on a side of each sheet, and successively discharge the printed sheets, printed side up, horizontally through said rear side; and printed sheet receiving and stacking means for receiving the discharged printed sheets and forming therefrom a printed sheet stack in which the printed sheets, printed side up, are successively disposed, from top to bottom, in the order in which they were discharged from said rear side of said printing section, said printed sheet receiving and stacking means including:

a plurality of vertically oriented helical drive members supported behind said rear side of said printing section and having top end portions, said helical drive members being positioned to receive and support opposite side edges of printed sheets discharged from said printing section and being rotatable to move the supported sheets upwardly, in a mutually spaced, parallel array, and then cause the supported sheets to vertically exit said helical drive members, in the order that the supported sheets were discharged from said printing section, to form a printed sheet stack upon said top end portions of said helical drive members, said plurality of vertically oriented helical drive members including a first laterally spaced apart pair of helical drive members disposed rearwardly of said printing section and positioned to receive opposite side edges of printed sheets discharged from said printing section, and a second laterally spaced apart pair of helical drive members disposed rearwardly of said first laterally spaced apart pair of helical drive members and positioned to receive opposite side edges of the discharged sheets, and said second pair of helical drive members being downwardly offset from said first pair of helical drive members, and a drive system operative to simultaneously rotate said plurality of helical drive members.

13. The printer of claim 12 wherein said printer is an inkjet printer.

14. The printer of claim 12 wherein:

said plurality of helical drive members include a first pair of helical drive members positioned to laterally receive and support one side edge of each printed sheet discharged from said printing section, and a second pair of helical drive members positioned to receive and laterally support the opposite side edge of each printed sheet discharged from said printing section, and said drive system is operative to rotate said first pair of helical drive members in one direction, while simultaneously rotating said second pair of helical drive members in an opposite direction, in a manner causing the oppositely rotating first and second pairs of helical drive members to frictionally exert a rearward force on the printed sheets that they support.

15. The printer of claim 12 wherein:

each of said top end portions of said plurality of helical drive members is generally horizontally oriented.

16. The printer of claim 12 wherein:

each of said helical drive members has a helically coiled body portion having, along its length, a horizontally elongated cross-section.

17. The printer of claim 12 further comprising:

wall means, disposed generally above said top end portions of said helical drive members, for forming around said printed sheet stack a barrier limiting horizontal movement thereof relative to said top end portions of said helical drive members.

18. A printer comprising:

a printing section having a rear side, said printing section being operative to receive a stack of paper sheets, imprint selected ink-based indicia on a side of each sheet, and successively discharge the printed sheets, printed side up, horizontally through said rear side; and printed sheet receiving and stacking means for receiving the discharged printed sheets and forming therefrom a printed sheet stack in which the printed sheets, printed side up, are successively disposed, from top to bottom, in the order in which they were discharged from said rear side of said printing section, said printed sheet receiving and stacking means including:

a plurality of vertically oriented helical drive members supported behind said rear side of said printing section and having top end portions, said helical drive members being positioned to receive and support opposite side edges of printed sheets discharged from said printing section and being rotatable to move the supported sheets upwardly, in a mutually spaced parallel array, and then cause the supported sheets to vertically exit said helical drive members, in the order that the supported sheets were discharged from said printing section, to form a printed sheet stack upon said top end portions of said helical drive members, each of said helical drive members having a helically coiled body portion having, along its length, a horizontally elongated cross-section, and each of said helically coiled body portion having a metal core portion externally coated with a low friction, high strength, wear resistant plastic material, and a drive system operative to simultaneously rotate said plurality of helical drive members.

19. The printer of claim 18 wherein:

said plastic material is an ultra high molecular weight polyethylene material.

* * * * *